US006629669B2

(12) United States Patent
Jensen

(10) Patent No.: US 6,629,669 B2
(45) Date of Patent: Oct. 7, 2003

(54) CONTROLLED SPIN PROJECTILE

(76) Inventor: Warren S. Jensen, Rte. 1, Box 187, Arco, ID (US) 83213

( * ) Notice: Subject to any disclaimer, the term of this patent is extended or adjusted under 35 U.S.C. 154(b) by 0 days.

(21) Appl. No.: 09/881,790

(22) Filed: Jun. 14, 2001

(65) Prior Publication Data

US 2002/0190156 A1 Dec. 19, 2002

(51) Int. Cl.[7] ..... F42B 10/48
(52) U.S. Cl. ..... 244/3.23; 102/529
(58) Field of Search ..... 244/130, 200, 244/3.1, 3.24, 3.23; 102/501, 517, 526, 529, 430, 439, 444, 519, 524, 490

(56) References Cited

U.S. PATENT DOCUMENTS 1,531,624 A * 3/1925 Richardson ..... 102/517
3,343,488 A * 9/1967 Sherwood
4,016,817 A * 4/1977 Blanco ..... 12/519
4,109,582 A 8/1978 Haep et al. ..... 102/93
4,718,348 A 1/1988 Ferrigno ..... 102/439
4,754,707 A 7/1988 Ahlers ..... 102/527
4,813,635 A * 3/1989 Paterson et al.
5,164,538 A 11/1992 McClain III, Harry T. . 102/517
5,932,836 A * 8/1999 White
6,085,662 A 7/2000 Nilsson ..... 102/526

* cited by examiner

*Primary Examiner*—Galen L. Barefoot
(74) *Attorney, Agent, or Firm*—Joseph W. Holland

(57) ABSTRACT

A projectile and a method of launching a projectile from a barrel. The projectile of the present invention may be matched to a pre-selected barrel rifling to produce a controlled spin rate. Controlled spin rate is characterized by substantially balanced forward and axial deceleration. Substantially balanced forward and axial deceleration is characterized by an axial speed that decreases in relationship to the decrease in forward speed. Substantially balanced forward and axial deceleration produces a trajectory that is characterized by a gyroscopic stability factor that remains highly stable over a given distance of a trajectory. Gyroscopic stability is controlled during the projectile's flight by controlling the spin damping moment as a design element. Control of the spin damping moment may be achieved by incorporating physical features in the projectile's design and manufacture and/or may result from the incorporation of physical features imparted upon the projectile during launch.

19 Claims, 13 Drawing Sheets

CONTROLLED SPIN PROJECTILE

BACKGROUND OF THE INVENTION

1. Technical Field

This invention relates generally to projectiles and more specifically to a projectile and a method of launching a projectile from a barrel to produce a controlled spin rate.

2. Background Art

Where the gyroscopic stability factor, $S_g$, of a projectile in flight exceeds one, a gyroscopic stability condition is present. The gyroscopic stability factor may be defined as follows:

$$S_g=(I_x/I_y)\times(pd/V_w)\times(2I_x/\rho\pi d^5)$$

where:

$I_x$=axial moment of inertia of the projectile $I_y$=forward moment of inertia of the projectile $V_w$=velocity d=projectile diameter p=spin rate of the projectile ρ=air density Alternately, the gyroscopic stability factor may be defined as follows:

$$S_g=P^2/4M=I_x^2p^2/2pI_ySdV^2C_{M\alpha}$$

where,

P=the sum of epicyclic turning rates

M=mach number $I_x$=axial moment of inertia of the projectile p=projectile axial spin in radians/second $I_y$=forward moment of inertia of the projectile S=projectile reference area $S=d^2/4$ d=projectile diameter V=velocity $C_{M\alpha}$=pitching moment coefficient The relationship between the axial moment of inertia $I_x$ and the forward moment of inertia of the projectile $I_y$ is readily observed. Additionally the above expressions attempt to characterize the relationship between a projectile's forward velocity, spin rate and geometry and the effect that these variables may have on gyroscopic stability.

It is generally believed that a projectile may be made gyroscopically stable by increasing the spin rate of the projectile. It is also widely believed that if a projectile is gyroscopically stable at the muzzle, it will be gyroscopically stable throughout its flight.

Practically speaking, however, the spin rate p decreases more slowly than the forward velocity, and therefore, the gyroscopic stability factor $S_g$, continues to increase throughout the flight of the projectile. Designers usually prefer a gyroscopic stability factor $S_g$>1.2 to 1.5 at departure from the muzzle, but because spin rate decreases more slowly than the forward velocity it is also possible to introduce too much spin to a projectile. This condition is commonly characterized as "over-stabilization". It has been observed that a projectile may become unstable by being "over-stabilized", however, most designers and commentators have not been terribly concerned with this aspect of flight as it is also commonly held that small arm fire is ineffective past the range where instability due to "over-stabilization" may occur, for instance, in the range of 2000 to 4000 yards.

"Over-stabilization" is a popular mischaracterization used to describe a phenomenon wherein the axial speed of the projectile continues to increase in proportion to the forward speed. As a result, the projectile becomes incapable of following the bending trajectory and the longitudinal axis of the projectile continues to nose up in relation to the bending trajectory. This effect may be referred to as a decrease in tractability. The relationship between excess gyroscopic stability and lack of stability in flight has been previously observed. FIG. 11 is a schematic representation depicting the relationship between gyroscopic stability GS and distance D in two projectiles manufactured and launched according to the prior art, a 7.62 mm and a 50 caliber. As can be readily seen, in each case the value for gyroscopic stability GS effectively continues to increase from the muzzle until termination of flight at T in the range of 2300 to 2500 yards. As will be seen, the relationship between a maximum GS value and a starting GS value produces the following ratios: 7.62 mm—approximately 9.50:2.20 or 4.32:1 and 50 caliber—approximately 5.60:1.60 or 3.50:1.

Skin friction at the surface of the projectile has a direct effect on the axial velocity of a projectile. A spin damping coefficient $M_S$ may be defined as follows:

$$M_S=-(\rho/2)\times A\times C_{spin}(B\times Ma\times Re)\times V_w^2\times d(pd/V_w)\times e_c$$

where:

ρ=air density

A=projectile cross section area $C_{spin}$=the spin damping moment coefficient

B=projectile geometry

Ma=mach number

Re=Reynolds number $V_W$=velocity d=projectile diameter p=spin rate of the projectile $e_c$=unit vector in the direction of the projectile's longitudinal axis A spin damping moment may be defined as follows:

$$\tfrac{1}{2}\rho V^2Sd(pd/V)C_{spin}$$

where:

ρ=air density

V=projectile velocity

S=projectile reference area d=projectile diameter p=spin rate of the projectile $C_{spin}$=the spin damping moment coefficient The relationship between the spin damping moment coefficient and the spin damping moment may be observed in the above formulas. Particularly, the greater the spin damping moment coefficient for any given atmospheric condition, projectile geometry, projectile velocity, both axial and forward and the ratio of axial spin to forward velocity, the greater the spin damping moment. The relationship between spin damping moment coefficient and forward velocity has likewise been observed.

FIGS. 12A and 12B are schematic representations depicting generally the relationship between axial deceleration, forward deceleration and distance in two projectiles of the prior art, a 7.62 mm and a 50 caliber. As can be seen in either case, the rate of decrease in forward deceleration exceeds the rate of decrease in axial deceleration in both cases and as a result, there is an increased probability of the occurrence of "over-stabilization" and as a result, instability in flight.

FIG. 13 is a schematic representation depicting the relationship between spin damping moment coefficient, SDMC, and forward velocity, MACH, in two projectiles manufactured and launched according to the prior art, a 7.62 mm and a 50 caliber. As can be seen, in each case the spin damping moment coefficient in either case remains in the range of approximately −0.018 to −0.027 regardless of forward velocity.

The relationship characterized by the expression pd/V, projectile diameter times the spin rate of the projectile divided by the velocity, expressed in spin per caliber of travel, has also been previously observed. FIG. 14 is a schematic representation depicting the relationship between projectile diameter times the spin rate of the projectile divided by the velocity, pd/V, and distance D in two projectiles manufactured and launched according to the prior art, a 7.62 mm and a 50 caliber. As can be readily seen, in each case the spin per caliber of travel effectively continues to increase from the muzzle until termination of flight at T in the range of 1300 to 2500 yards. Additionally, the relationship between a maximum pd/V value and a starting pd/V value produces the following ratios: 7.62 mm—approximately 4.22:1.94 or 2.17 and 50 caliber—approximately 5.07:2.35 or 2.15. In each instance, it should be noted that the value for pd/V, at termination of flight, may be characterized as increasing.

It may be advantageous to the efficiency of a projectile's flight to control the spin damping moment coefficient of the projectile by controlling various parameters of projectile design including projectile aerodynamics, projectile surface area and projectile surface features and finish. By controlling the spin damping moment coefficient the gyroscopic stability factor may be maintained within a predetermined desirable range and overall ballistic efficiency maybe improved.

SUMMARY OF THE INVENTION

The present invention is directed to a projectile and a method of launching a projectile from a barrel, the projectile having an axial velocity upon launching. The projectile of the present invention may be matched to a pre-selected barrel rifling to produce a controlled spin rate. "Controlled spin rate", as used herein, is characterized by substantially balanced forward and axial deceleration. "Substantially balanced forward and axial deceleration", as used herein, is characterized by an axial speed that decreases in relationship to the decrease in forward speed. Substantially balanced forward and axial deceleration produces a trajectory that may be depicted by a curve exhibiting a relatively narrow band of values for the gyroscopic stability factor over a given distance of a trajectory.

Gyroscopic stability is controlled during the projectile's flight by controlling the spin damping moment as a design element. More particularly, control of the spin damping moment may result from a projectile design that incorporates a relatively low aerodynamic drag value with physical features incorporated in the projectile's design and manufacture, or produced during launch, that increase the skin friction at the surface of the projectile. Alternately, the projectile may include both physical features incorporated in the projectile's during manufacture and physical features which are imparted upon the projectile during launch.

In one preferred embodiment of the invention, a projectile is provided having a relatively low density and a relatively low drag coefficient. A projectile manufactured and launched according to the present invention exhibits a drag coefficient in the range of 0.100 to 0.250. A physical feature is then identified and selected that will produce a pre-selected projectile surface area and/or surface relief that produces a calculated spin damping moment. For instance a projectile may be matched to a barrel including riflings that produce physical scoring on the exterior surface of the projectile which cover a predetermined percentage of the exterior surface of the projectile to produced a controlled effect on the spin damping moment resulting in a controlled deceleration of axial velocity of the projectile during flight.

In one preferred embodiment of the invention, the spin stabilized projectile is manufactured having sufficiently low aerodynamic drag so that upon launching, the ensuing axial drag, as increased by designed physical features, will cause the projectile to exhibit a controlled spin rate and controlled axial deceleration. The trajectory of such a projectile is characterized by substantially balanced forward and axial deceleration. The result is a projectile which is aerodynamically stable while not being overspun to the point of induced instability. The lower aerodynamic drag and the increased axial drag are substantially balanced throughout the projectile's flight to produce a controlled spin and increase in the spin damping moment. During flight, the gyroscopic stability of the projectile is not increasing or decreasing dramatically.

The gyroscopic stability factor of a projectile of the present invention, a projectile exhibiting substantially balanced forward and axial deceleration, should remain in the range of greater than or equal to 1.0 to less than or equal 3.0. Alternately, the gyroscopic stability factor of a projectile of the present invention, a projectile exhibiting substantially balanced forward and axial deceleration, should remain in the range of greater than or equal to 1.0 through and including three times the initial value at the muzzle. A projectile manufactured and launched according to the present invention, should exhibit increased tractability and stability particularly down range. Balancing forward and axial deceleration should produce a trajectory that is characterized by a nose that maintains a near direct into oncoming air orientation throughout its trajectory. The gyroscopic stability factor of the projectile increases or decreases only within a relatively narrow range.

Physical features which may contribute to a calculated control of a projectile's spin damping moment include but are not limited to the total surface area of the projectile, the length of the projectile, the length, depth and number of lands and grooves engraved by barrel riflings on launch, surface roughness and material density of the projectile. Controlled axial drag imparts a controlled axial deceleration. Physical features which may be calculated to affect the spin damping moment include but are not limited to the following:

a. control of projectile total surface area and total axial surface friction;
b. decrease in the density of constituent materials;
c. control of the number of lands and grooves in the rifle bore from which the projectile is shot and engraved, thereby controlling the number of engraved grooves on the projectile;
d. control of the length of engraving to control axial deceleration;
e. control of the depth of engraving to control axial deceleration;
f. control of the forms of engraving using trigonal, polygonal, and multi-cornered shapes to increase axial drag to control axial deceleration;
g. incorporation of fins, canards, wings, deflectors, and protrusions to control axial deceleration;

h. control of the surface roughness of the projectile to control axial deceleration;

i. any other feature manufactured into the projectile or caused by the engraving process which by effect controls the spin dampening moment and causes a gyroscopic balance the projectile's trajectory.

It is believed that the control of spin damping moment by the control and specification of physical features provides a projectile which in flight maintains gyroscopic stability within a specified range preventing increased yaw, increased precession, increased inaccuracy and projectile instability.

Historically, designers of projectiles for small arms have not been concerned with ballistic efficiency or the effects of "over-stabilization", primarily instability, at ranges beyond 2000 yards as it is commonly held that small arm fire is ineffective past this range. A projectile engraved and launched according to the teachings of the present invention, however, is designed to decelerate from supersonic flight through transonic to subsonic in a stable and predictable manner effective in a range beyond 3000 yards.

The present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

DETAILED DESCRIPTION OF THE INVENTION

Figure 1:
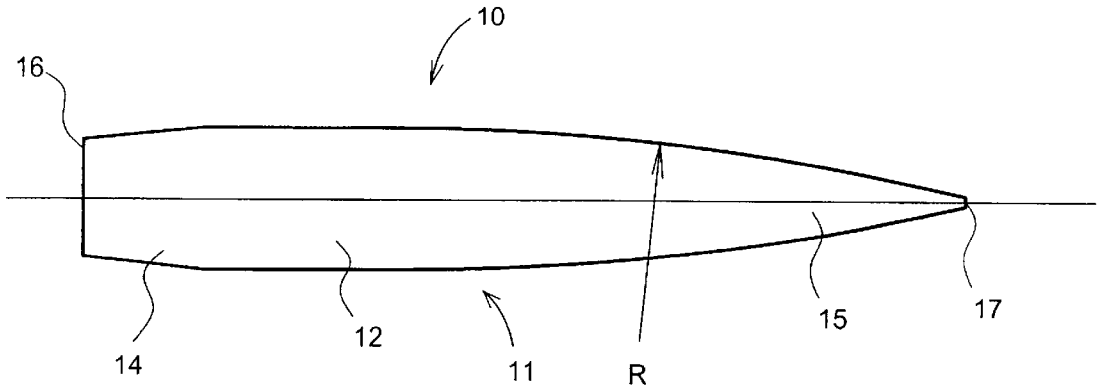
FIG. 1 is a representative side view of a projectile according to the invention.
Figure 2:
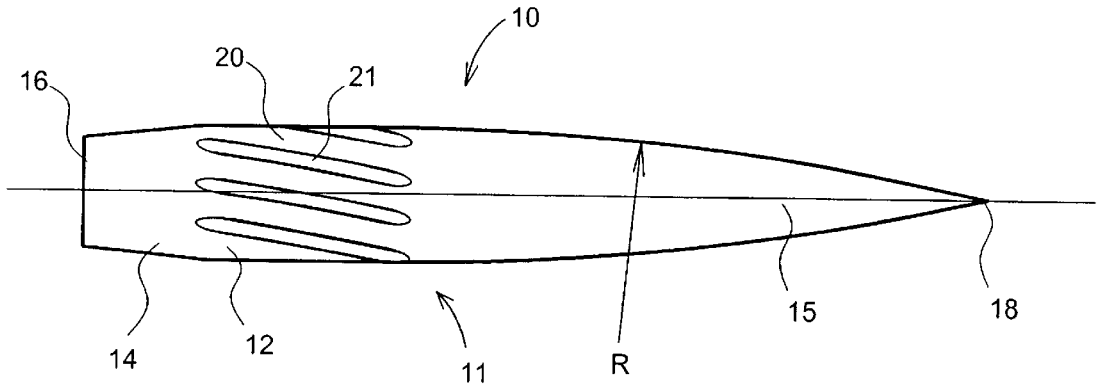
FIG. 2 is a representative side view of a projectile according to the invention.

Referring to FIGS. 1 through 5, projectile 10 is shown including body 11 having bearing surface 12 and ogive 15 which is continuous to and extends forward from bearing surface 12. Projectile 10 includes boattail 14 continuous to and extending rearward from bearing surface 12. Boattail 14 terminates at tail end 16. Ogive 15 is formed including relatively long radius R converging at méplate 17. Alternately, as shown in FIG. 2, ogive 15 may be formed including pointed tip 18. FIG. 1 is a representative side view of projectile 10 according to the invention having a low aerodynamic drag factor. FIG. 1 is a representative side view of projectile 10 prior to launching and engraving of physical features.

FIG. 2 is a representative side view of one embodiment of projectile 10 according to the invention including a pattern of alternating lands 20 and grooves 21 forming a physical feature which is imparted on the surface of bearing surface 12 of projectile 10 upon launching.

Figure 3:
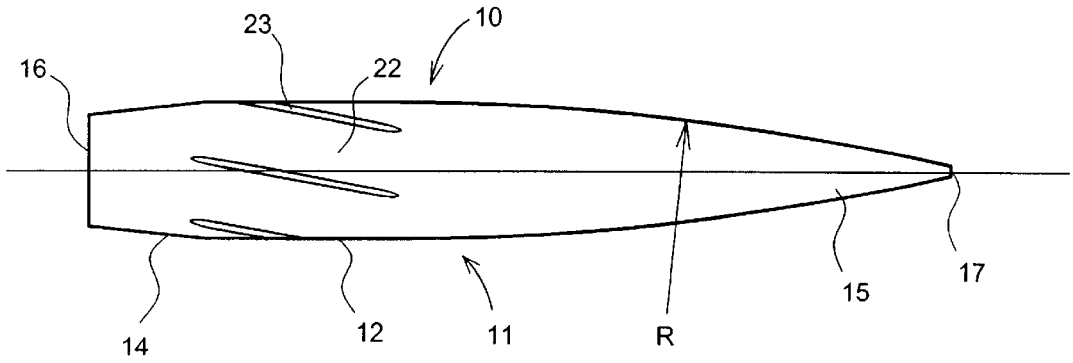
FIG. 3 is a representative side view of a projectile according to the invention.

FIG. 3 is a representative side view of projectile 10 according to the invention including a pattern of alternating lands 22 and grooves 23 forming a physical feature which is imparted on the surface of bearing surface 12 of projectile 10 during a manufacturing process.

Figure 4:
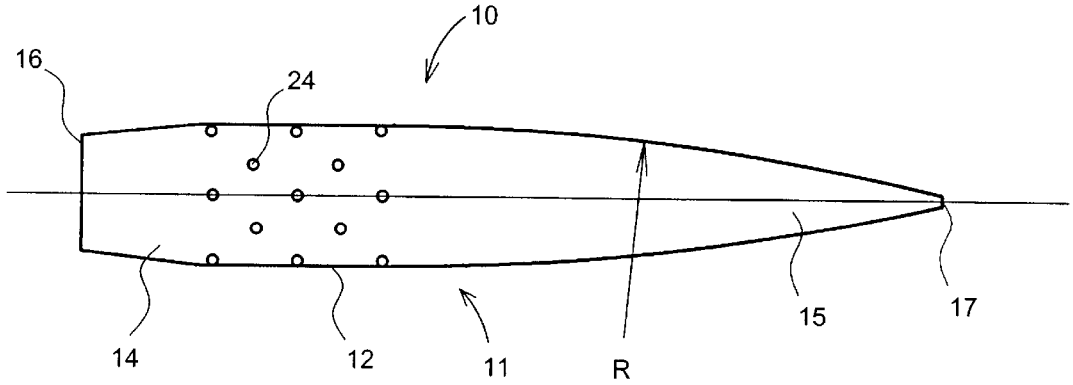
FIG. 4 is a representative side view of a projectile according to the invention.

FIG. 4 is a representative side view of projectile 10 according to the invention including a pattern of dimples 24 forming a physical feature which is imparted on the surface of bearing surface 12 of projectile 10 during a manufacturing process. Additional physical features may be added to the pattern of alternating lands 22 and grooves 23 shown in FIG. 3 or the pattern of dimples 24 shown in FIG. 4 during launch to achieve a desired ratio of surface area of projectile 10 including physical features to the total surface area of projectile 10 such that a substantially balanced forward and axial deceleration is achieved.

Figure 5:
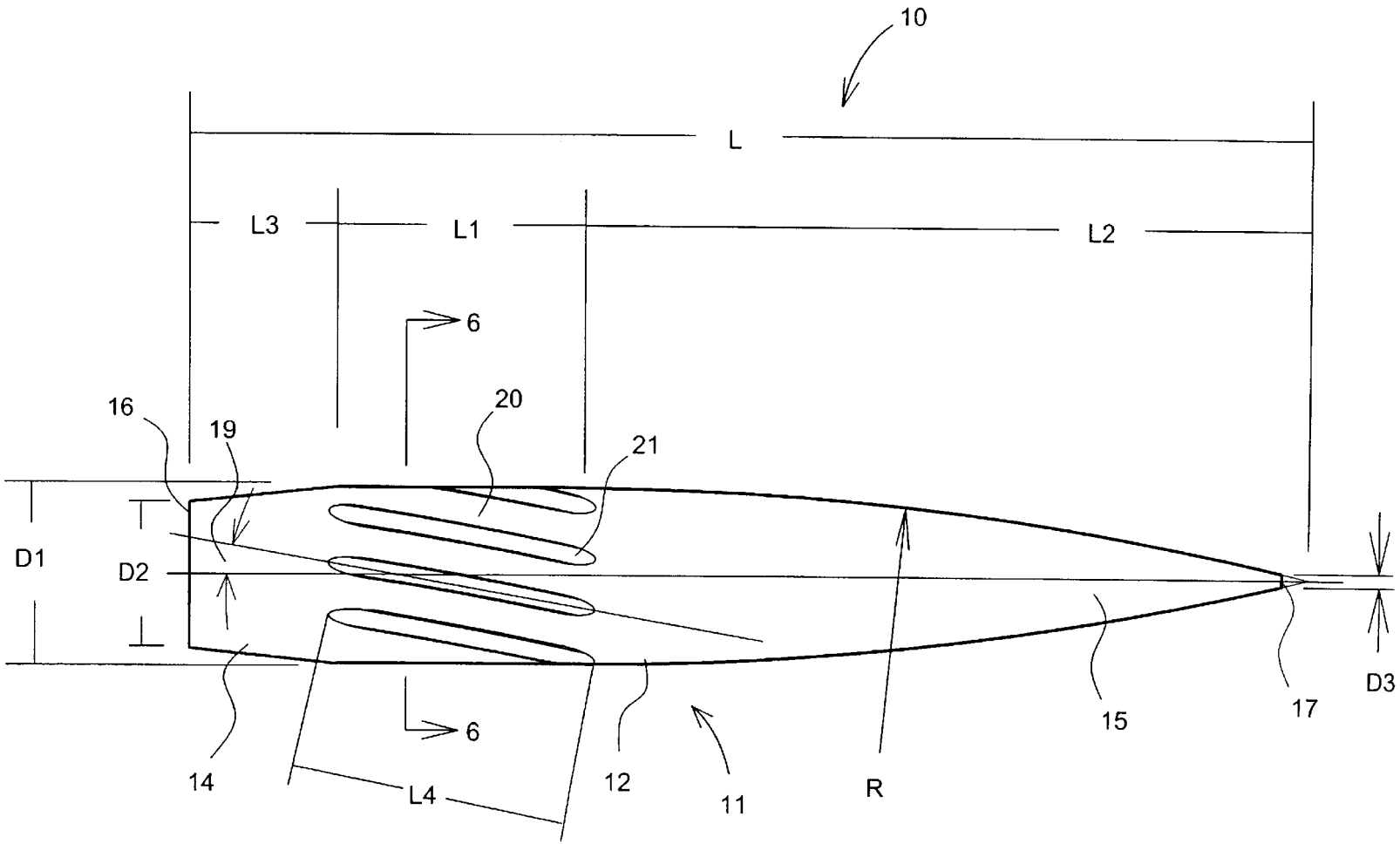
FIG. 5 is a representative side view of a projectile according to the invention.

FIG. 5 is a representative side view of projectile 10 according to the invention including a pattern of alternating lands 20 and grooves 21 forming a physical feature which is imparted on the surface of bearing surface 12 of projectile 10 upon launching. In the embodiment of the invention shown at FIG. 5, alternating lands 20 and grooves 21 include angle of attack 19 substantially equal to 5°±1°.

Figure 6:
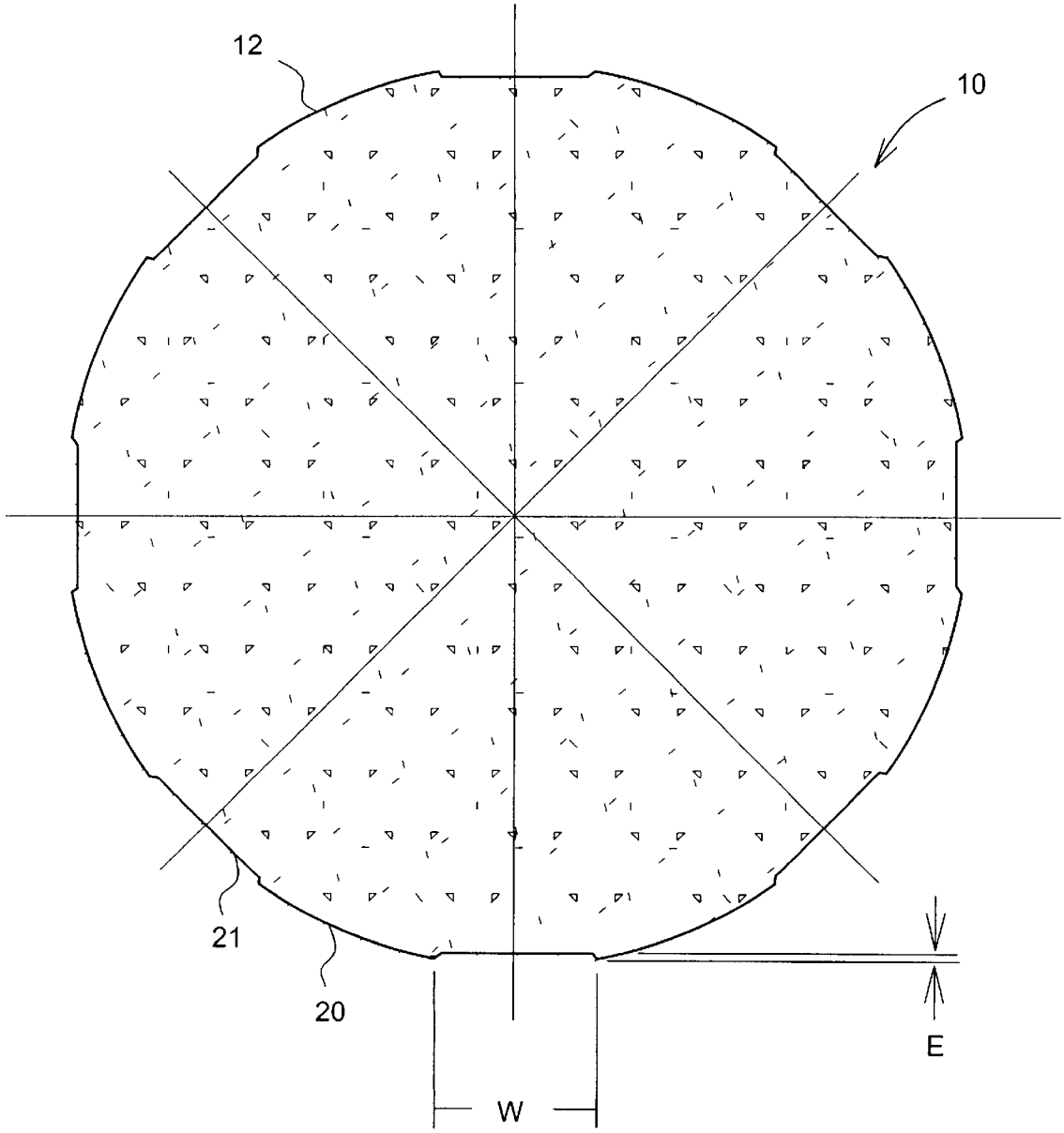
FIG. 6 a cross-sectional cutaway of a projectile according to the invention.

In the embodiment of the invention shown at FIG. 5, projectile 10 includes overall length L. Bearing surface 12 includes length L1 and diameter D1. Ogive 15 includes effective length L2 and is formed having a radius R. Tip 17 is configured as a flat having a diameter D3. Boattail 14 includes length L3 and diameter D2 at tail end 16. Grooves 21 include length L4 and, as shown in FIG. 6, width W and depth E.

According to one aspect of the invention, length L of projectile 10 equals 5.25 to 5.50 times diameter D1, length L1 of bearing surface 12 equals 1.25 to 1.50 times diameter D1 and length L2 of ogive 15 equals 3.10 to 3.25 times diameter D1. The length L3 of boattail 14 may equal 0.10 to 1.1 times diameter D1.

In the embodiment of the invention shown at FIG. 5, projectile 10 is shown in a .408 caliber. In this embodiment of the invention, projectile 10 is formed by machining a solid copper nickel alloy, for instance C-145, a Tellurium copper-alloy containing less than 1% Tellurium. C-145 has a density on the order of 0.322 lb./in.$^3$. Projectile 10, as shown in FIG. 5 will have a mass in the range of 400 grains to 430, depending upon nose configuration and length of boattail 14. Projectile 10, as shown at FIG. 5 includes an overall length L substantially equal to 2.217 inches. Bearing surface 12 has a length L1 substantially equal to 0.580 inches and diameter D1 substantially equal to 0.408 inches. Ogive 15 has length L2 substantially equal to 1.300 inches and is formed on a 7.00 inch radius. Tip 17 is configured as a flat having a diameter D3 equal to 0.020 inches. Boattail 14 includes length L3 substantially equal to 0.337 inches and diameter D2 at tail end 16 substantially equal to 0.340 inches resulting in a taper from bearing surface 12 to tail segment 14 substantially equal to 6.00 degrees. A projectile manufactured and launched according to the present invention exhibits a drag coefficient in the range of 0.100 to 0.250. Projectile 10 shown at FIG. 5 exhibits an drag coefficient substantially equal to 0.211.

The configuration shown in FIG. 5 results in projectile 10 having a ratio of length L1 over L substantially equal to 0.262, a ratio of length L2 over L substantially equal to 0.586 and a ratio of length L3 over L substantially equal to 0.158. Length L4 of grooves 21 is substantially equal to 0.686 in. As shown in FIG. 6, width W of grooves 21 is substantially equal to 0.100 in. and depth E is substantially equal to 0.004 in. The configuration shown in FIG. 5 results in projectile 10 having a ratio of depth E of groove 21 to diameter D1 approximately equal to 0.001. Otherwise stated, grooves 21 may be of virtually any depth, however, a depth E substantially equal to 1% of the projectile body diameter D1 is preferred.

The total surface area of projectile 10 as shown at FIG. 5 is substantially equal to 1.923 in.$^2$. The total surface area of bearing surface 12 as shown at FIG. 5 is substantially equal to 0.744 in.$^2$. The total aggregate area of grooves 20 as shown at FIG. 5 is substantially equal to 0.550 in.$^2$. The ratio of the aggregate areas of all groves 21 to total surface area of bearing surface 12 is substantially equal to 0.739. The ratio of the aggregate areas of all groves 21 to total surface area of projectile 10 is substantially equal to 0.285. The ratio of the total surface area of projectile 10 to the total surface of the physical feature as shown at FIG. 5 is substantially equal to 3.40:1. A projectile manufactured and launched according to the present invention includes a ratio of the total surface area of projectile 10 to the total surface of the physical feature as shown at FIG. 5 in the range of to 3.00:1 to 4.00:1.

FIG. 6 a cross-sectional cutaway taken through bearing surface 12 of projectile 10. Projectile 10 includes a plurality of alternating lands 20 and grooves 21. In this case, there are a total of eight lands 20 and 8 alternating grooves 21. Each groove 21 includes a depth E and a width W.

Figure 7:
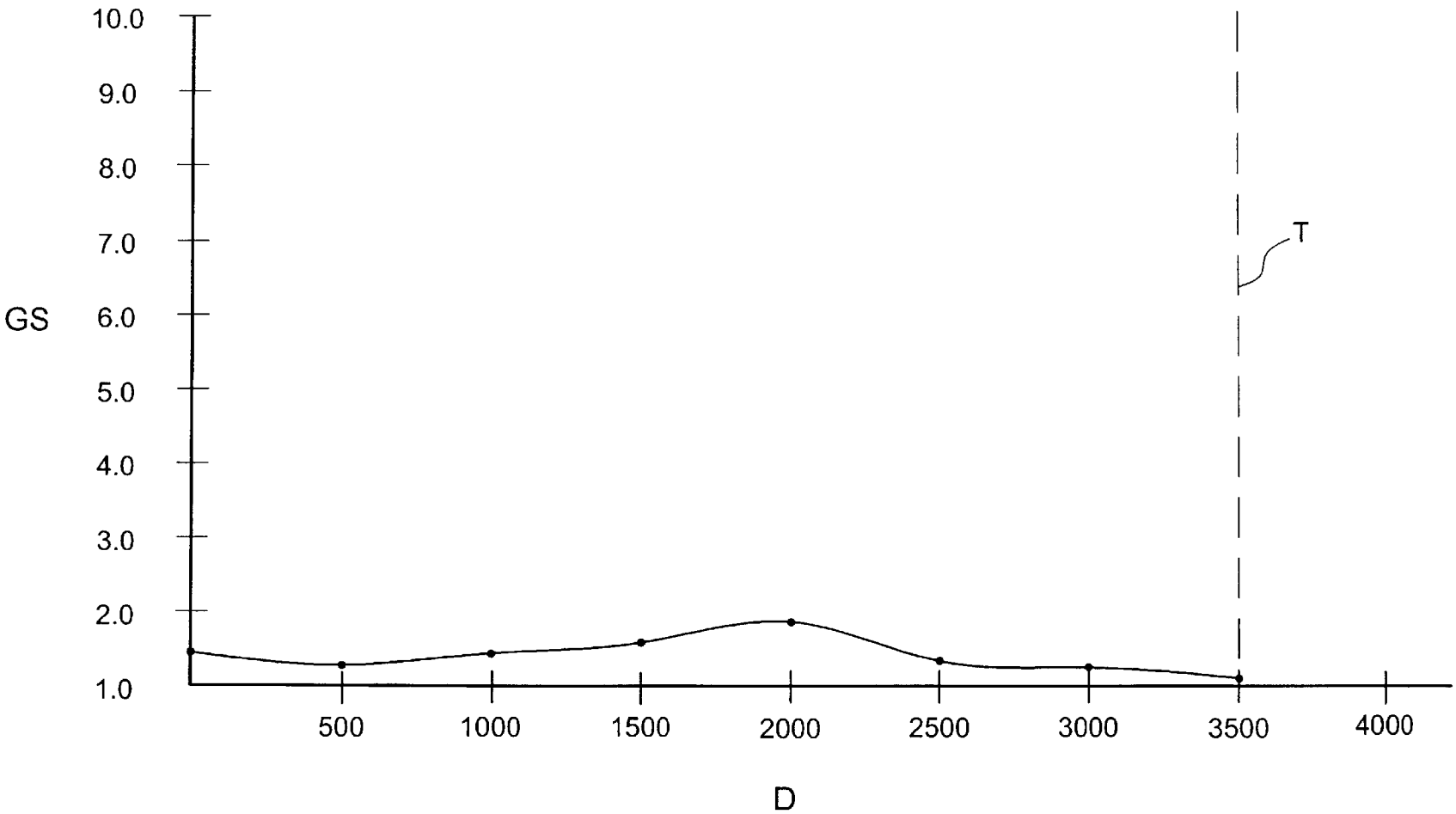
FIG. 7 is a schematic representation depicting the relationship between distance and gyroscopic stability in a projectile of the present invention.

FIG. 7 is a schematic representation depicting the relationship between gyroscopic stability GS and distance D in a projectile manufactured and launched according to the present invention. As can be readily seen, the value for gyroscopic stability GS remains in the range of 1.0 to 2.0 from the muzzle until termination of flight at T in the range of 3500 yards. As will be seen, the relationship between a maximum GS value and a starting GS value produces the following ratio: approximately 1.88:1.42 or 1.32:1. It should also be noted that the value for GS, at termination of flight, may be characterized as decreasing. Projectile 10, as shown at FIG. 5, exhibits a gyroscopic stability in the range of greater than or equal to 1.0 to less than or equal 3.0 for any given distance from the muzzle. In an alternate embodiment of the invention, the trajectory of projectile 10 is characterized by a gyroscopic stability greater than or equal to 1.0 through to three times the gyroscopic stability at the muzzle for any given distance from the muzzle.

Figure 8:
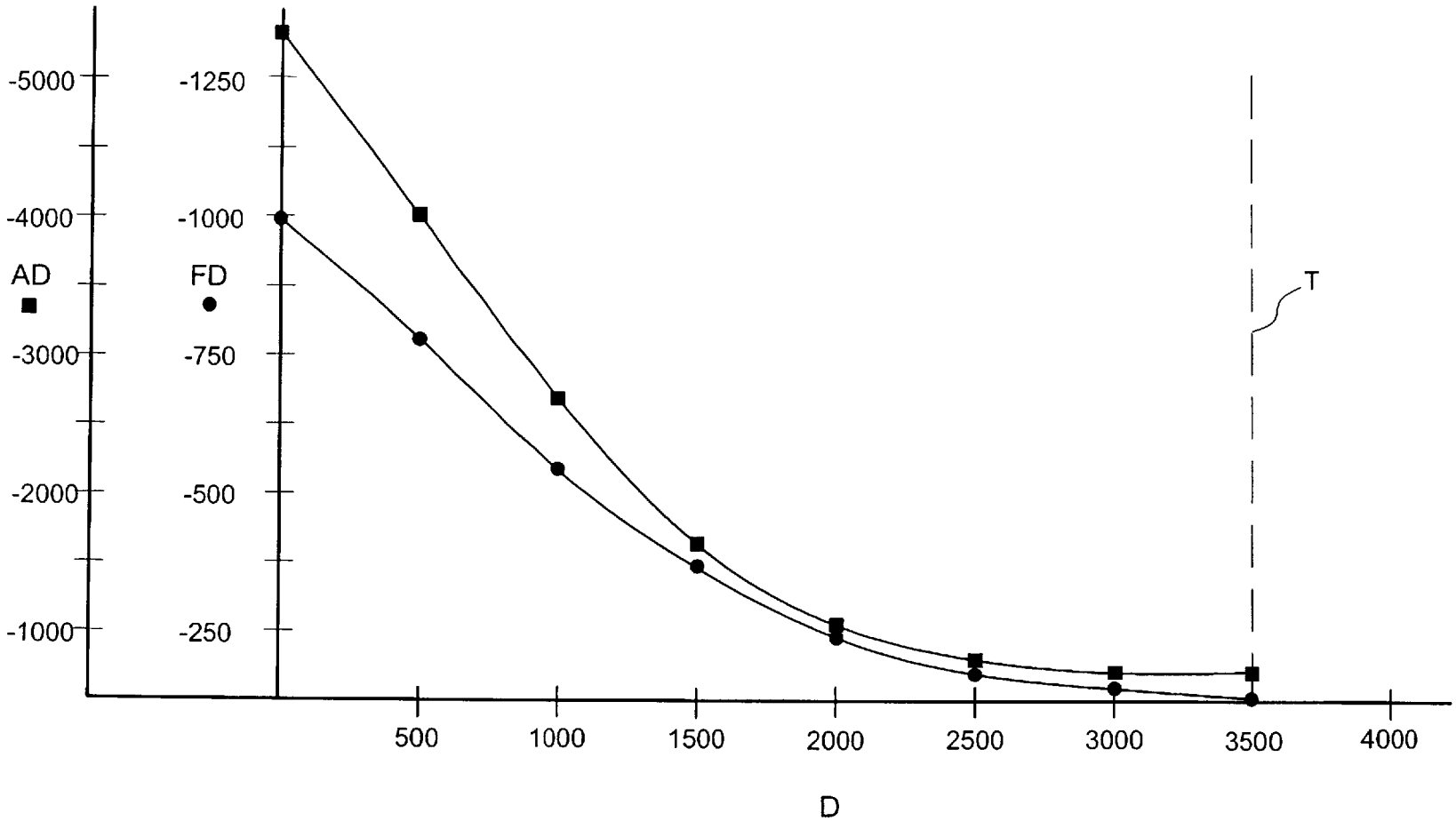
FIG. 8 is a schematic representation depicting generally the relationship between axial deceleration, forward deceleration and distance in a projectile of the present invention.

FIG. 8 is a schematic representation depicting the relationship between axial deceleration, forward deceleration and distance in a projectile of the present invention. As can be seen, the slope of both curves remains substantially equal from the muzzle until termination of flight at T in the range of 3500 yards. A projectile manufactured and launched according to the present invention includes a trajectory characterized by a rate of axial deceleration that is continuously decreasing throughout flight.

Figure 9:
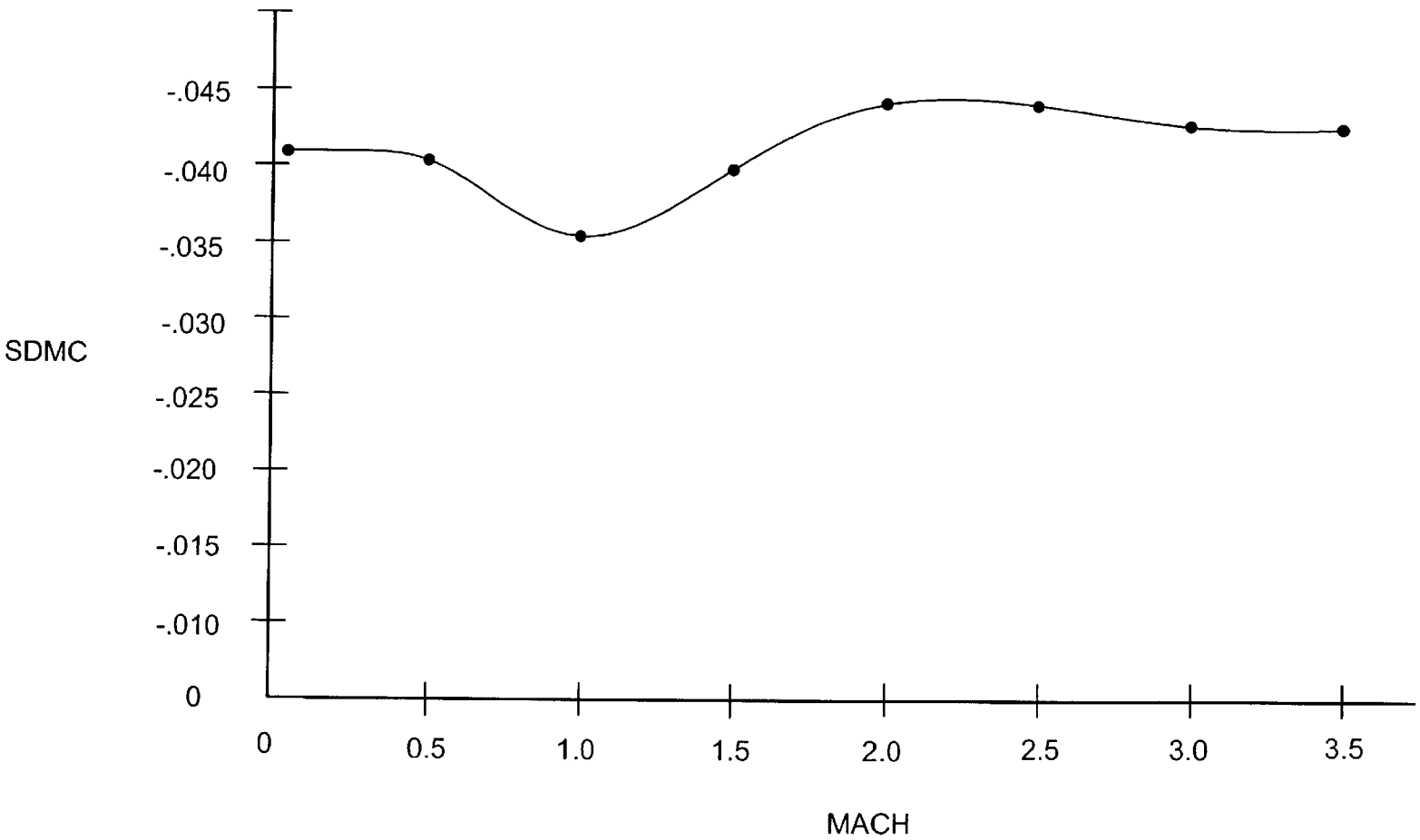
FIG. 9 is a schematic representation depicting generally the relationship between the spin damping moment coefficient and forward velocity in a projectile of the present invention.

FIG. 9 is a schematic representation depicting the relationship between the spin damping moment coefficient and forward velocity in a projectile of the present invention. Projectile 10, as shown at FIG. 5, exhibits a spin damping moment coefficient in the range of −0.035 to −0.045. It will be noted that the spin damping moment coefficient remains effectively in the range of approximately −0.035 to −0.045 throughout flight regardless of the forward velocity of the projectile. This represents a substantial increase in the spin damping moment coefficient over the prior art. As previously noted, the spin damping moment coefficient for projectiles representative of the prior art, remains effectively in the range of approximately −0.018 to −0.027 regardless of forward velocity. In one preferred embodiment of the invention, projectile 10 exhibits a ratio of a high spin damping moment coefficient to a low spin damping moment coefficient in the range of 1.25:1 to 1.45:1.

Projectile 10 exhibits a ratio of total projectile surface area to spin damping moment coefficient in the range of 45 to 50 during flight. Projectile 10 exhibits a ratio of density of the projectile to spin damping moment coefficient of the projectile in the range of 7.0 to 9.0

Figure 10:
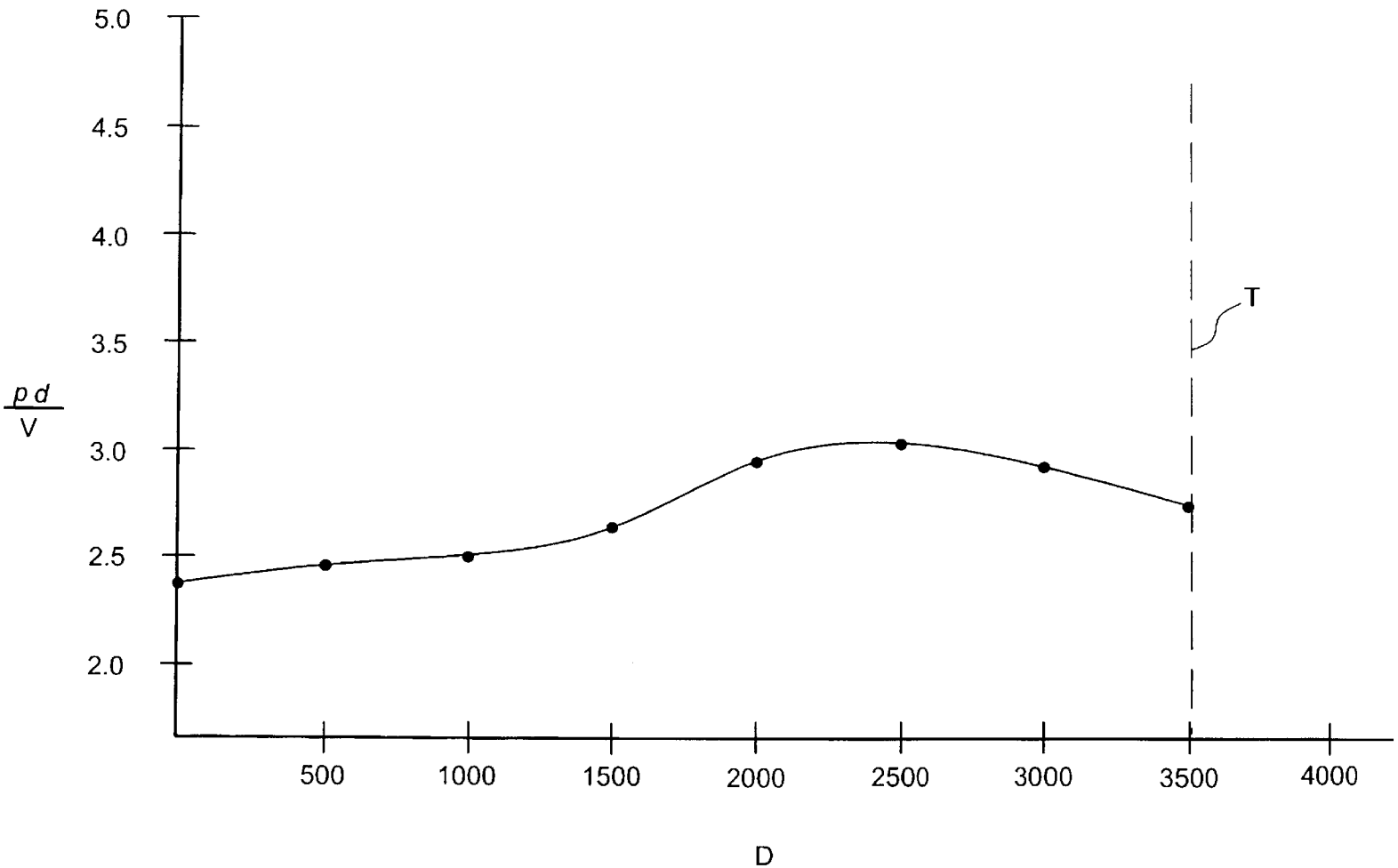
FIG. 10 is a schematic representation depicting generally the relationship between the spin rate of the projectile divided by the velocity, pd/V, and distance in a projectile of the present invention.
Figure 11:
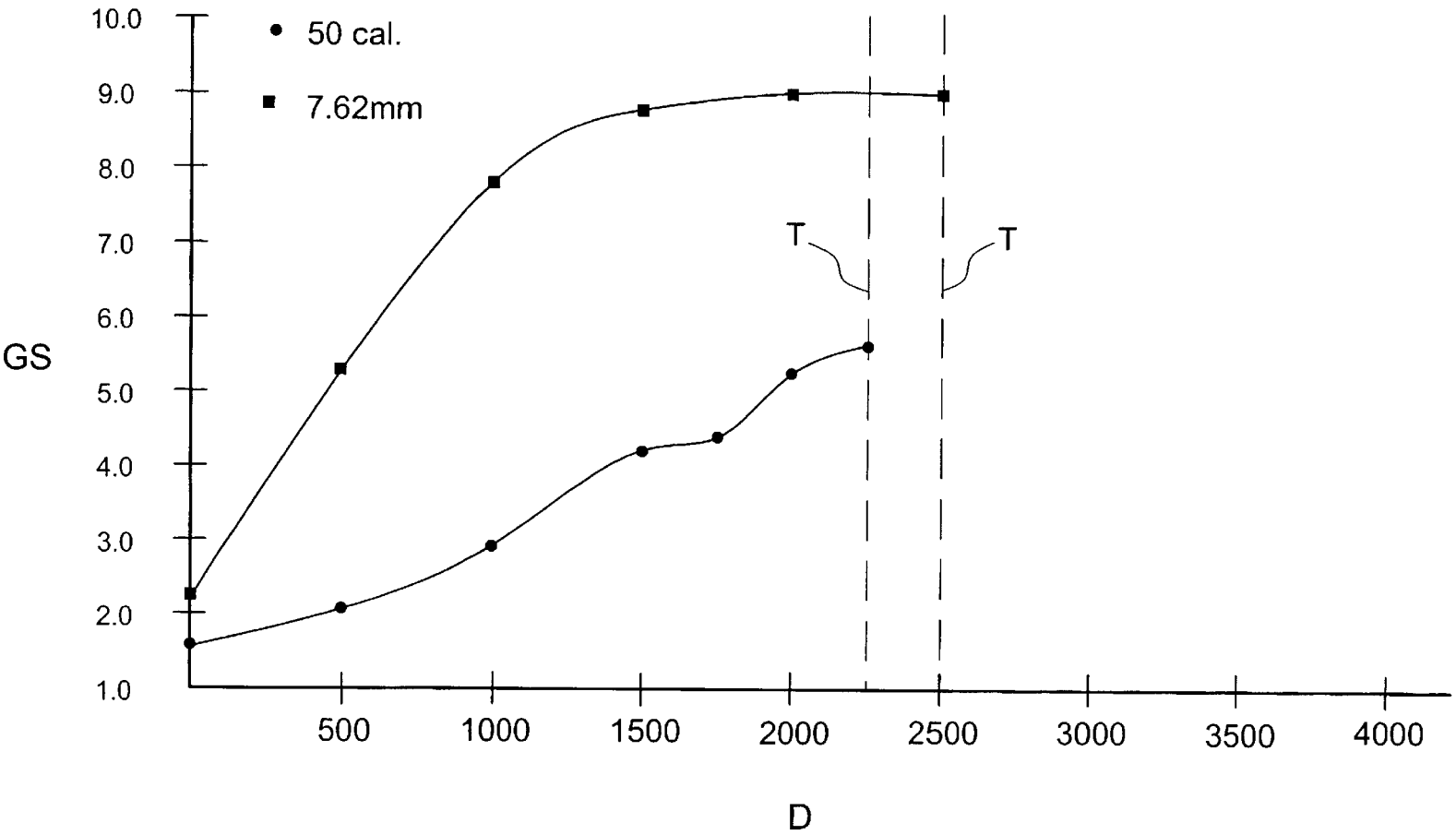
Figure 11 Prior Art
FIG. 11 is a schematic representation depicting generally the relationship between gyroscopic stability and distance in two projectiles manufactured and launched according to the prior art.
Figure 12A:
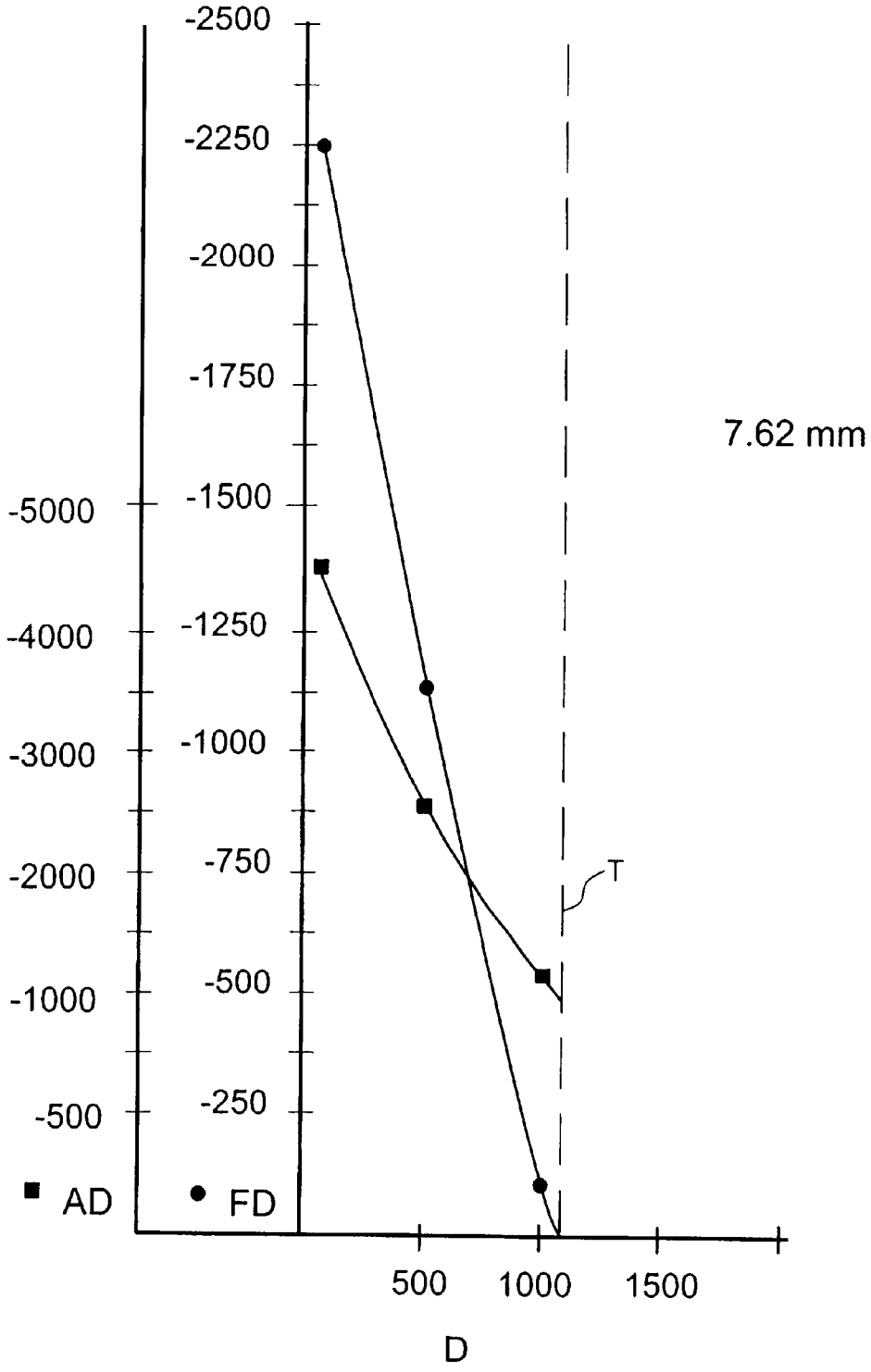
Figure 12A Prior Art
FIG. 12A is a schematic representation depicting generally the relationship between axial deceleration, forward deceleration and distance in a projectile of the prior art.
Figure 12B:
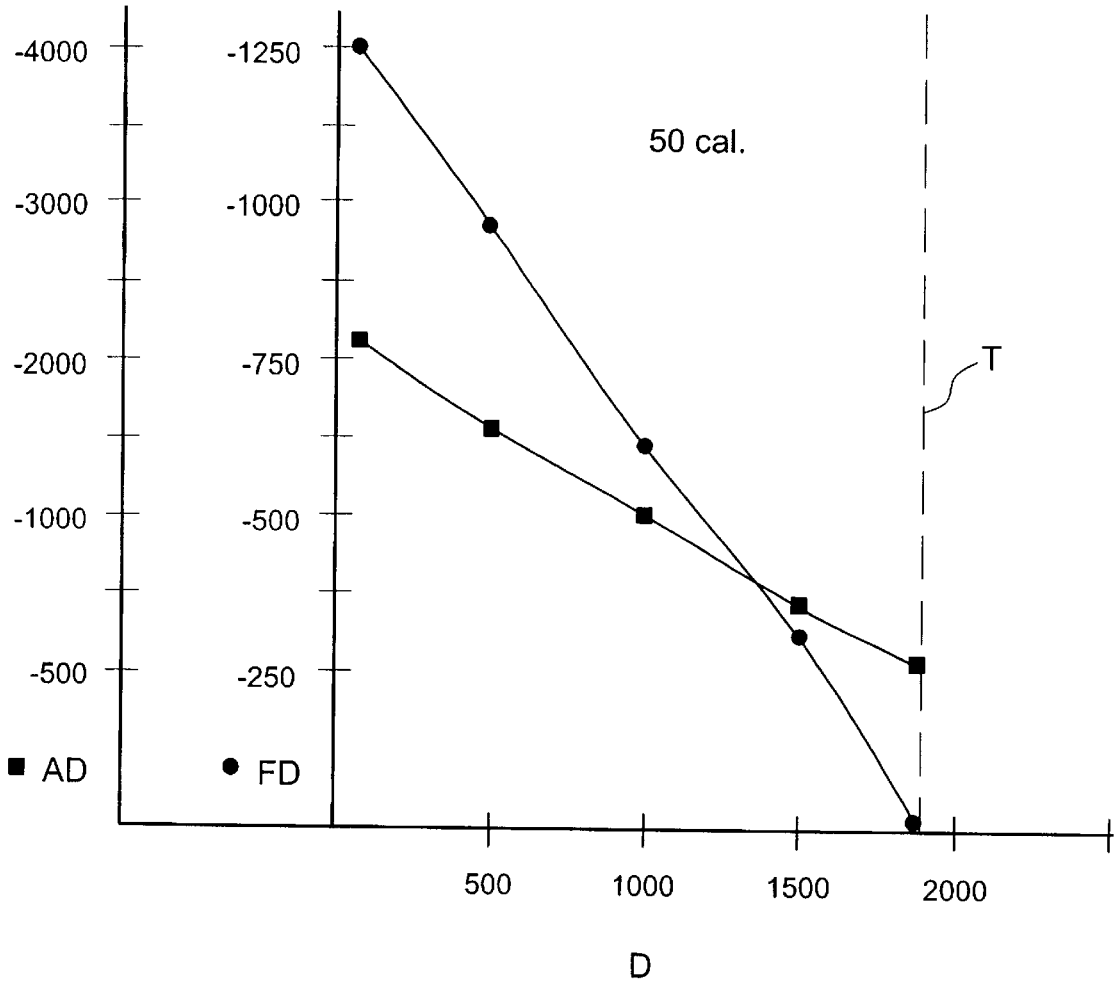
Figure 12B Prior Art
FIG. 12B is a schematic representation depicting generally the relationship between axial deceleration, forward deceleration and distance in a projectile of the prior art.
Figure 13:
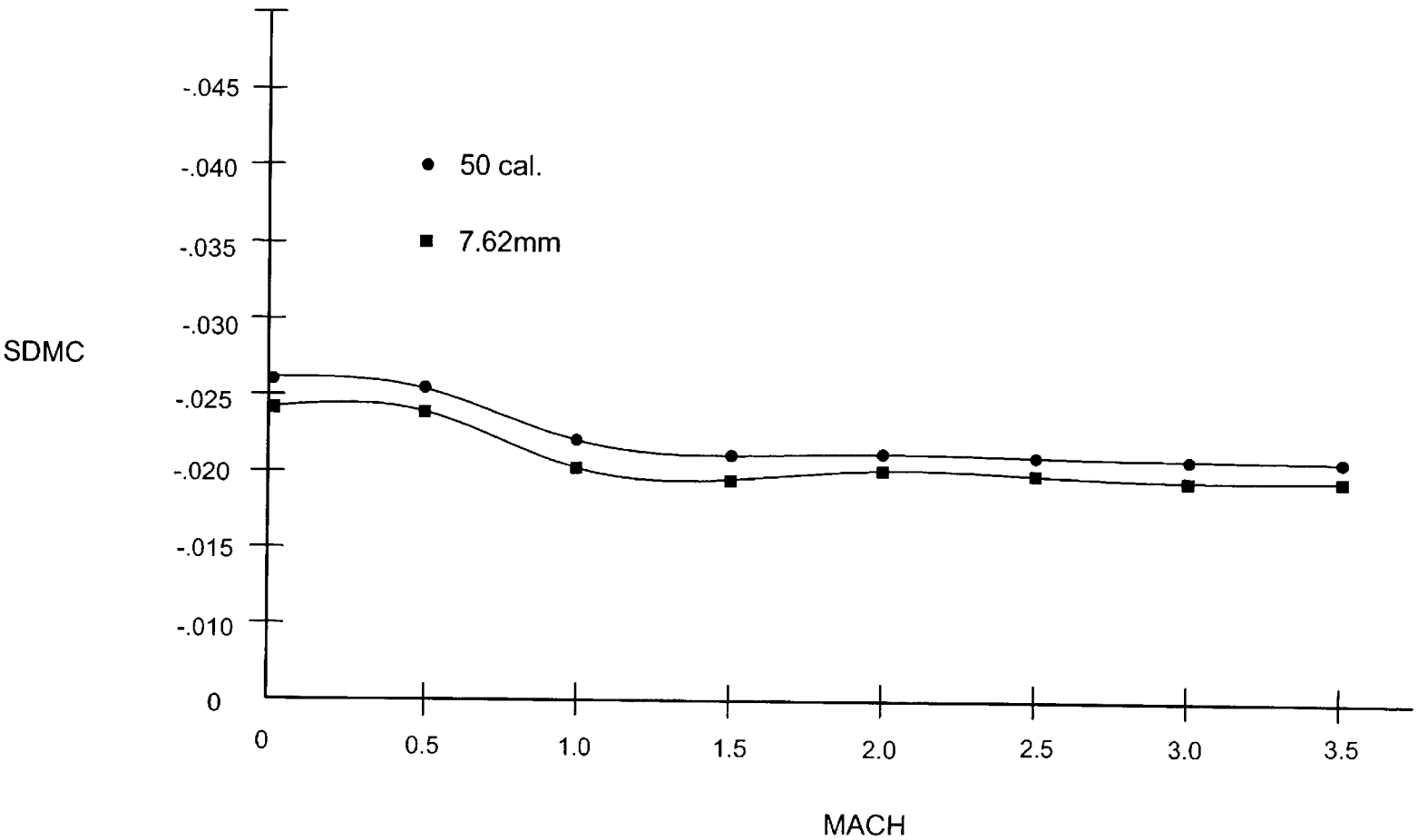
Figure 13 Prior Art
FIG. 13 is a schematic representation depicting generally the relationship between spin damping moment coefficient and forward velocity in two projectiles manufactured and launched according to the prior art.
Figure 14:
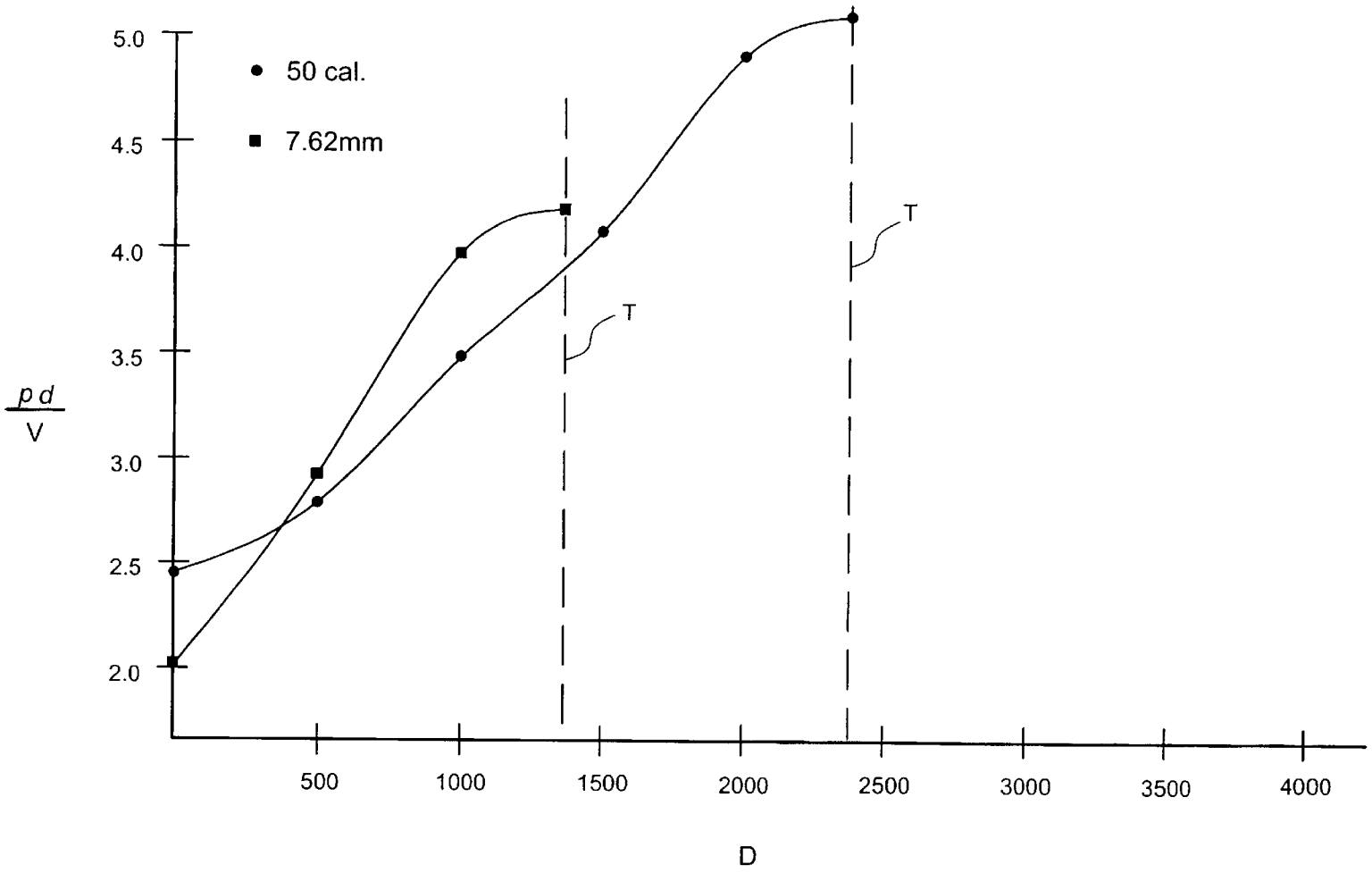
Figure 14 Prior Art
FIG. 14 is a schematic representation depicting generally the relationship between projectile diameter times the spin rate of the projectile divided by the velocity and distance in two projectiles manufactured and launched according to the prior art.

FIG. 10 is a schematic representation depicting the relationship between the spin rate of the projectile divided by the velocity as expressed in spin per caliber of travel, pd/V, and distance in a projectile of the present invention. As will be seen, the relationship between a maximum pd/V value and a starting pd/V value produces the following ratio: approximately 3.11:2.35 or 1.32:1. It should also be noted that the value for pd/V, at termination of flight, may be characterized as decreasing.

Without limiting the invention, it is believed that the negative increase in the spin damping moment coefficient, over projectile design for spin stabilized projectile of the prior art may be due the spin/forward movement stabilizing effect of the air flow passing through grooves 21, (shown in FIG. 5). The value for spin per caliber of travel, pd/V, for projectile 10 remains fairly constant and the spin damping moment coefficient decreases from the point of exit from the muzzle. Grooves 21 may act effectively as fins to control spin per caliber of travel, pd/V, to match the speed of oncoming air. It is believed that projectiles of the prior art are not capable of acting in this manner for the reasons previously discussed. Without limiting the invention, it is believed that because the value for spin per caliber of travel, pd/V, remains fairly constant, a more laminar flow of air about projectile 10 results preventing heat transfer that is associated with a more turbulent air flow that results from the effects of "over-stabilization". The heat transfer that is associated with a more turbulent air flow results in a decrease in the friction coefficient allowing an associated increase in the spin per caliber of travel, pd/V. As the spin rate, pd/V, increases the engravings of a projectile of the prior art spin past the flow of oncoming air and, rather than channeling the air through the grooves, the air about the projectile increases in temperature and becomes more turbulent.

While this invention has been described with reference to the detailed embodiments, this is not meant to be construed in a limiting sense. Various modifications to the described embodiments, as well as additional embodiments of the invention, will be apparent to persons skilled in the art upon reference to this description. It is therefore contemplated that the appended claims will cover any such modifications or embodiments as fall within the true scope of the invention.

What is claimed is:

1. A projectile comprising:

a body including a bearing surface and an ogive continuous to and extending forward from the bearing surface;

a plurality of grooves and a plurality of lands formed on the bearing surface of the projectile in an alternating pattern for imparting a predetermined spin damping moment to the projectile in flight; and a ratio of a total surface the projectile to a total surface area of the physical feature in the range of to 3.00:1 to 4.00:1.

2. The projectile of claim 1 further comprising a drag coefficient in the range of 0.100 to 0.250.

3. The projectile of claim 1 further comprising a trajectory characterized by a forward rate of deceleration and an axial rate of deceleration that are substantially balanced.

4. The projectile of claim 1 further comprising a trajectory characterized by a controlled spin rate.

5. The projectile of claim 1 wherein the physical feature is imparted to the projectile during manufacture of the projectile.

6. The projectile of claim 1 wherein the physical feature is imparted to the projectile during launch of the projectile.

7. The projectile of claim 1 further comprising a ratio of total projectile surface area to spin damping moment coefficient in the range of 45 to 50.

8. The projectile of claim 1 further comprising a ratio of density of the projectile to spin damping moment coefficient of the projectile in the range of 7.0 to 9.0.

9. The projectile of claim 1 further comprising a trajectory characterized by a continuously decreasing rate of axial deceleration.

10. The projectile of claim 1 further comprising a trajectory characterized by a gyroscopic stability during flight in the range of greater than or equal to 1.0 to less than or equal 3.0.

11. The projectile of claim 1 further comprising a trajectory characterized by a gyroscopic stability during flight in the range of greater than or equal to 1.0 to three times the gyroscopic stability at the muzzle.

12. The projectile of claim 1 further comprising a trajectory characterized by a spin damping moment spin damping moment coefficient during flight in the range of −0.035 to −0.045.

13. The projectile of claim 1 further comprising a trajectory characterized by a ratio of a spin rate of the projectile to a forward velocity of the projectile during flight in the range of 1.25:1 to 1.40:1.

14. A method for launching a projectile along a trajectory characterized by a controlled spin rate and a substantially balanced forward and axial deceleration including the steps of:

forming the projectile having a body including a bearing surface and an ogive continuous to and extending forward from the bearing surface and an aerodynamic drag factor upon launching and during flight in the range of 0.100 to 0.250;

forming the projectile having ratio of a spin rate of the projectile to a forward velocity of the projectile upon launching and during flight in the range of 1.25:1 to 1.40:1; and imparting a physical feature to a bearing surface of the projectile, the physical feature having a depth substantially equal to 1% the caliber of the projectile and a ratio of a total surface area of projectile to the total surface of the physical feature in the range of to 3.00:1 to 4.00:1 for imparting an axial surface friction upon launching and during flight required to produce a trajectory characterized by a continuously decreasing rate of axial deceleration.

15. A projectile comprising:

a body including a bearing surface and an ogive continuous to and extending forward from the bearing surface;

the projectile including a pre-selected physical feature having a depth substantially equal to 1% the caliber of the projectile;

the projectile including a relatively low drag coefficient in the range of 0.100 to 0.250; and the projectile including a ratio of a total surface area of projectile to a total surface of the physical feature in the range of to 3.00:1 to 4.00:1.

16. The projectile of claim 15 further comprising a trajectory characterized by a forward rate of deceleration and an axial rate of deceleration that are substantially balanced.

17. The projectile of claim 15 wherein the spin stabilized trajectory further comprises a controlled spin rate.

18. The projectile of claim 15 wherein the spin stabilized trajectory further comprises a gyroscopic stability during flight in the range of greater than or equal to 1.0 to three times the gyroscopic stability at the muzzle.

19. The projectile of claim 15 wherein the spin stabilized trajectory further comprises a ratio of a high spin damping moment coefficient to a low spin damping moment coefficient during flight in the range of 1.25:1 to 1.45:1.

* * * * *